US006618909B1

(12) United States Patent
Yang

(10) Patent No.: US 6,618,909 B1
(45) Date of Patent: Sep. 16, 2003

(54) CHILD-PROOF BUTTON

(76) Inventor: Shih-Sheng Yang, P.O. Box 82-144, Taipei (TW)

( * ) Notice: Subject to any disclaimer, the term of this patent is extended or adjusted under 35 U.S.C. 154(b) by 0 days.

(21) Appl. No.: 10/209,882

(22) Filed: Aug. 2, 2002

(30) Foreign Application Priority Data

Mar. 28, 2002 (TW) ..... 91203862 U

(51) Int. Cl.[7] ..... A44B 1/44
(52) U.S. Cl. ..... 24/113 MP; 24/113 R; 24/94
(58) Field of Search ..... 24/113 MP, 113 R, 24/94, 95, 114.05, 114.9, 114.11, 114.12, 691, 621; 411/501

(56) References Cited

U.S. PATENT DOCUMENTS 1,805,937 A * 5/1931 Berge ..... 411/372
2,983,009 A * 5/1961 Dritz ..... 24/113 R
4,928,362 A * 5/1990 Collas et al. ..... 24/114.4
4,941,234 A * 7/1990 Watanabe et al. ..... 24/113 MP
4,967,452 A * 11/1990 Watanabe et al. ..... 24/94
5,940,940 A * 8/1999 Tanikoshi et al. ..... 24/108

* cited by examiner

*Primary Examiner*—Robert J. Sandy
*Assistant Examiner*—André L. Jackson
(74) *Attorney, Agent, or Firm*—Leong C. Lei

(57) ABSTRACT

A child-proof button includes a base formed with a tubular portion at one end thereof, and a disc portion at another end thereof, the tubular portion being used for riveting, the disc portion having a plurality of notches, a metal body portion made of zinc and by die-casting and having a plurality of pawls at a circumferential edge thereof and a recess at a center thereof, the metal body portion being provided with a plurality of through holes, the base being fitted in the metal body portion with some of the notches coincident with the through holes, the metal body portion together with the base being further processed with injection molding and plastic not only covers the metal body portion but also enters coincident the through holes and the notches, thereby forming a plastic cover even more firmly attached to the metal body portion.

5 Claims, 4 Drawing Sheets

CHILD-PROOF BUTTON

BACKGROUND OF THE INVENTION

1. Field of the Invention

This invention is related to a child-proof button, and in particular to one having a plastic cover which is closely engaged with the mechanical parts, thereby preventing children from separating the button by biting.

2. Description of the Prior Art

The conventional button generally has a plastic cover made by injection molding, which encloses the surface of the metal button body. However, the plastic cover cannot be firmly engaged with the metal body, so that the plastic cover will often and easily disengage from the metal body portion. Children are very curious and may bite the button. This will make the plastic cover separate from the metal body portion, and the child may easily swallow the plastic cover, which is hazardous to their health.

SUMMARY OF THE INVENTION

This invention is related to a child-proof button, and in particular to one having a plastic cover which is closely engaged with the mechanical parts, thereby preventing children from separating the button by biting.

The primary object of the present invention is to provide a child-proof button which has a plastic cover which can be firmly engaged with the metal body portion, thereby preventing the child from separating the button by biting, and therefore preventing the child from swallowing the button.

It is another object of the present invention to provide a child-proof button which can be easily manufactured and processed, thereby increasing the productivity.

It is still another object of the present invention to provide a child-proof button in which the metal component parts are made by die-casting, thereby reducing the manufacturing cost.

According to a preferred embodiment of the present invention, a child-proof button includes a base formed with a tubular portion at one end thereof, and a disc portion at another end thereof, the tubular portion being used for riveting, the disc portion having a plurality of notches, a metal body portion made of zinc and by die-casting and having a plurality of pawls at a circumferential edge thereof and a recess at a center thereof, the metal body portion being provided with a plurality of through holes, the base being fitted in the metal body portion with some of the notches coincident with the through holes, the metal body portion together with the base being further processed with injection molding and plastic not only covers the metal body portion but also enters coincident the through holes and the notches, thereby forming a plastic cover even more firmly attached to the metal body portion.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
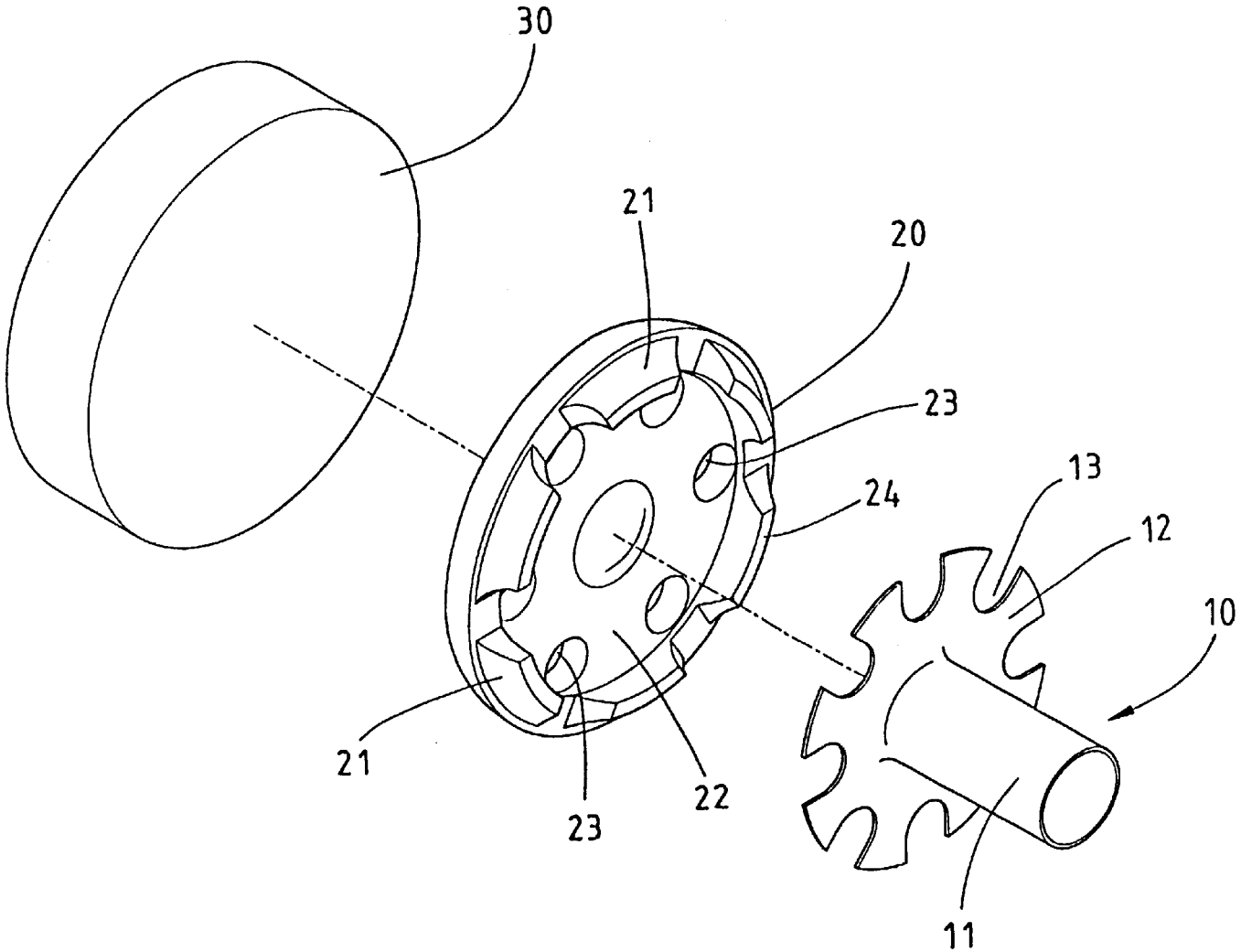
FIG. 1 is an exploded view of the present invention.
Figure 2:
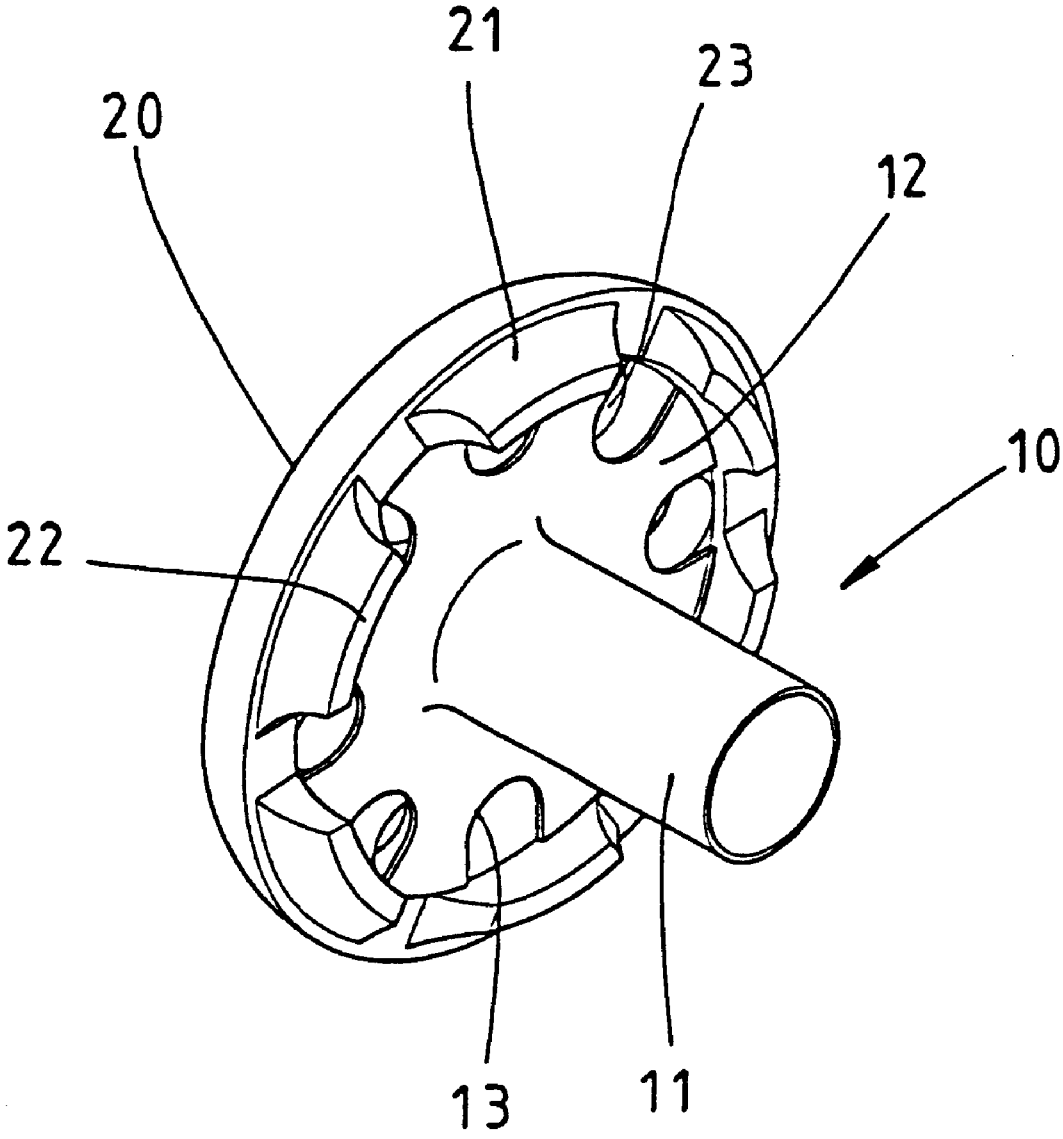
FIG. 2 is a perspective view of the present invention.

With reference to the drawings, and in particular to FIGS. 1 and 2, the child-proof button according to the present invention comprises a base 10, a metal body portion 20, and a plastic cover 30.

The base 10 is formed with a tubular portion 11 at one end, and a disc portion 12 at the other end. The tubular portion 11 of the base is used for riveting. The disc portion 12 has eight notches 13.

The metal body portion 20 is made of zinc and by die-casting. The metal body portion 20 is small in size, so a number of metal body portions 20 can be formed by one mold, and is fit for mass production. The metal body portion 20 has a plurality of pawls 21 at the circumferential edge and a recess 22 at the center. The recess 22 is provided with six through holes 23. The pawl 21 is larger at the root portion and a smaller edge 24 is at the free end.

Figure 3:
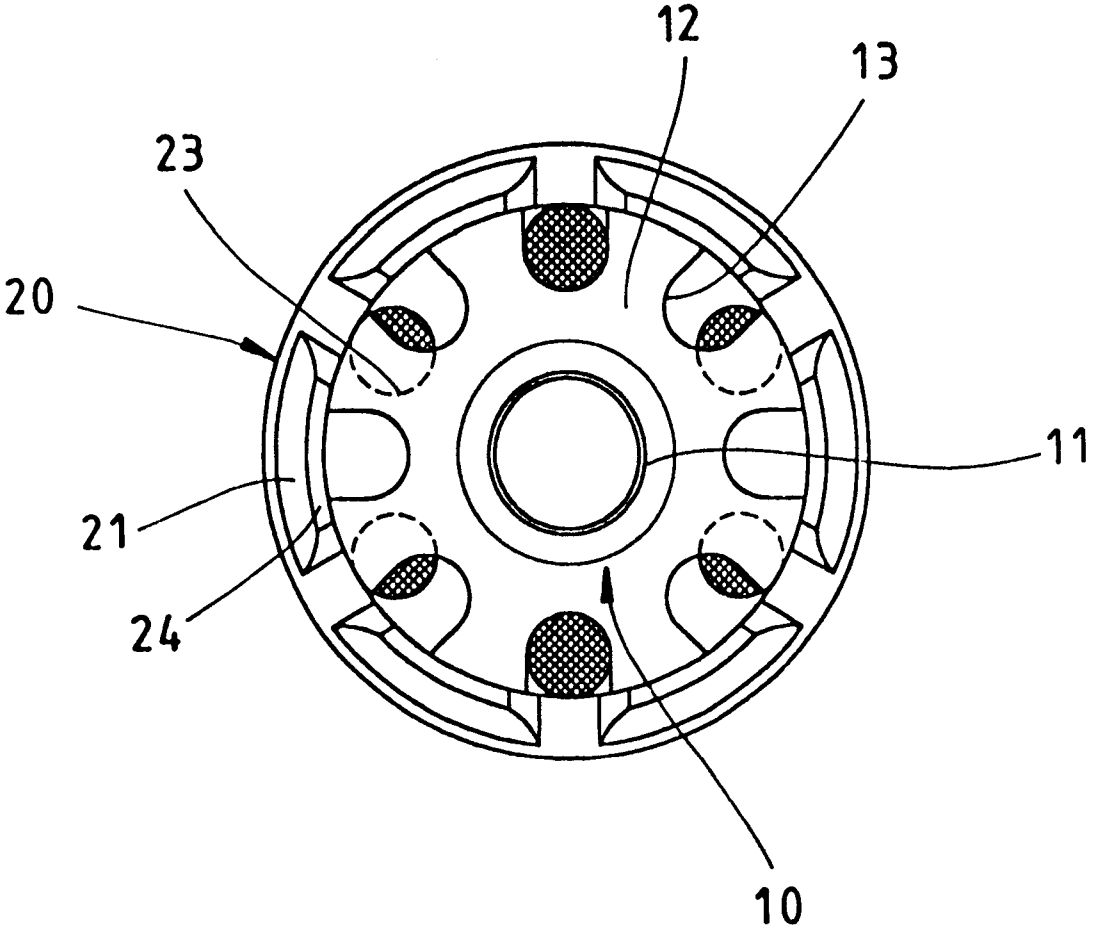
FIG. 3 is a bottom view of the present invention.
Figure 4:
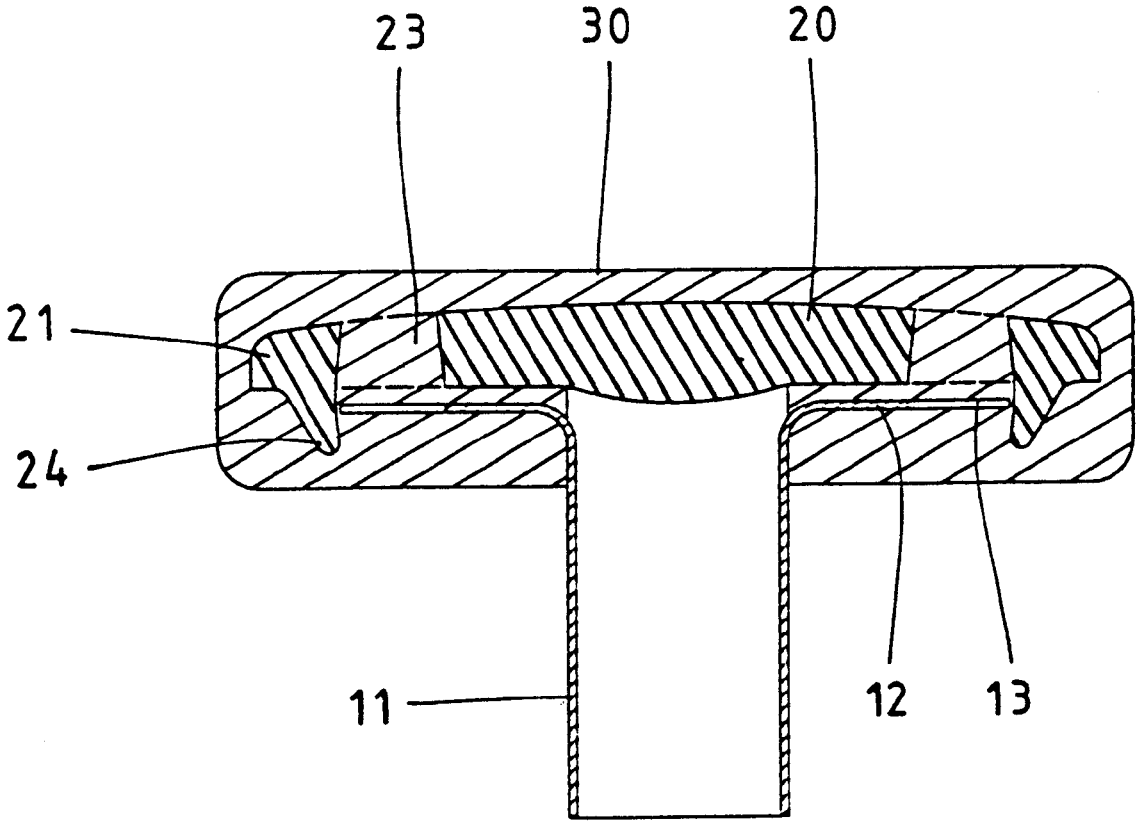
FIG. 4 is a sectional view of the present invention.

When in assembly (see FIGS. 3 and 4), the base 10 is fitted in the recess 22 of the metal body portion 20. The recess 22 has an uneven, convex surface, so that there will be a small clearance between the base 10 and the metal body portion 20. The base 10 is fitted in the metal body portion 20 in such a way that the number of the notches of the base 10 are not equal to the number of through holes in the metal body portion 20, so that when the base 10 is fitted in the metal body portion 20, some, but not all of the notches will be coincident with the through holes 23. Then, the edges 24 of the pawl 21 of the metal body portion are bent inwardly to engage firmly with the base 10. Thereafter, the metal body portion 20, together with the base 10, is further processed with injection molding. The plastic will not only cover the metal body portion 20, but will also enter the coincident through holes 23 and the notches 13, thereby making the plastic cover 30 even more firmly attached to the metal body portion 20.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A child-proof button comprising:

a base formed with a tubular portion at one end thereof, and a disc portion at another end thereof, said tubular portion being used for riveting, said disc portion having a plurality of notches;

a metal body portion made of zinc and by die-casting and having a plurality of pawls at a circumferential edge thereof and a recess at a center thereof, said metal body portion being provided with a plurality of through holes, said base being fitted in said metal body portion with some of said notches coincident with said through holes, said metal body portion together with said base being further processed with injection molding and plastic not only covers said metal body portion but also enters coincident said through holes and said notches, thereby forming a plastic cover even more firmly attached to said metal body portion.

2. The child-proof button as claimed in claim 1, wherein said pawls are larger at a root portion thereof and a smaller edge is at a free end thereof, said edge being bent inwardly to engage firmly with said base.

3. The child-proof button as claimed in claim 1, wherein said recess has an uneven, convex surface.

4. The child-proof button as claimed in claim 1, wherein said disc portion of said base has eight notches.

5. The child-proof button as claimed in claim 1, wherein said metal body portion has six through holes.

* * * * *